United States Patent [19]

Iwasaki

[11] 4,109,489

[45] Aug. 29, 1978

[54] ELECTRICAL CONNECTING DEVICE FOR A HAND-OPERATED KNITTING MACHINE

[75] Inventor: Yasuhiro Iwasaki, Kodaira, Japan

[73] Assignee: Silver Seiko Ltd., Kodaira, Japan

[21] Appl. No.: 774,531

[22] Filed: Mar. 4, 1977

[30] Foreign Application Priority Data

Sep. 3, 1976 [JP] Japan ..... 51-27123

[51] Int. Cl.[2] ..... D04B 15/66

[52] U.S. Cl. ..... 66/75.2

[58] Field of Search ..... 66/75.2, 154 A, 50 R (U.S. only)

[56] References Cited

U.S. PATENT DOCUMENTS

| | | | |
|---|---|---|---|
| 3,805,558 | 4/1974 | Protti | 66/154 A |
| 3,817,059 | 6/1974 | Knause | 66/75.2 X |
| 4,015,445 | 4/1977 | Kahan et al. | 66/75.2 |

FOREIGN PATENT DOCUMENTS

| | | | |
|---|---|---|---|
| 680,615 | 8/1939 | Fed. Rep. of Germany | 66/75.2 |
| 2,059,615 | 6/1972 | Fed. Rep. of Germany | 66/75.2 |
| 484,223 | 6/1973 | Japan | 66/75.2 |
| 579,168 | 8/1976 | Switzerland | 66/75.2 |

*Primary Examiner*—Mervin Stein
*Assistant Examiner*—Andrew M. Falik
*Attorney, Agent, or Firm*—Lane, Aitken, Dunner & Ziems

[57] ABSTRACT

In a hand-operated knitting machine having a machine body, a needle bed, a carriage slideably mounted on said needle bed, and electrical means on said machine body and on said carriage, means for providing electrical connection between said electrical means without mechanically or otherwise interfering with machine operation. Interference is avoided by the use of a coiled electrical cord suspended from a lever pivotally mounted on a rod mounted on the machine body, the lever being positioned above the carriage and needle bed.

12 Claims, 7 Drawing Figures

ELECTRICAL CONNECTING DEVICE FOR A HAND-OPERATED KNITTING MACHINE

BACKGROUND OF THE INVENTION

This invention relates to a hand-operated knitting machine, and more particularly to an electrical connection apparatus for establishing an electrical connection for power or control signals between electrical devices on the knitting machine body and on the movable carriage on the machine body.

Knitting machines have been proposed using electromechanical actuators, including electromagnets on the movable carriage, for selecting knitting needles in the needle bed. Often, other electric or electronic elements such as photoelectric pulse generators including light sources and photoelectric transducers are used. In such machines the power source for driving or controlling such elements on the carriage is conventionally provided on the machine body or the needle bed, and an electrical connection must, therefore, be established between the carriage and the machine body or needle bed.

A connecting cable or cord including a plurality of separate wires or conductors usually provides an inexpensive, simple, and relatively reliable means for effecting such a connection. However, such a conventional cable or cord means is not without problems and disadvantages. It can, for example, become entangled with the moving elements in the machine, thereby disturbing smooth operation or jamming the carriage or other machine elements.

SUMMARY OF THE INVENTION

Accordingly, an object of the invention is to provide, in a knitting machine, an electrical connection device using a connecting cable or cord means for electrically connecting the machine body or needle bed to the carriage in a manner which minimizes the likelihood of the cable or cord becoming entangled during machine operation.

BRIEF DESCRIPTION OF THE DRAWINGS

The invention will be described below in detail, referring to the drawings, in which.

DETAILED DESCRIPTION OF THE INVENTION

Figure 1:
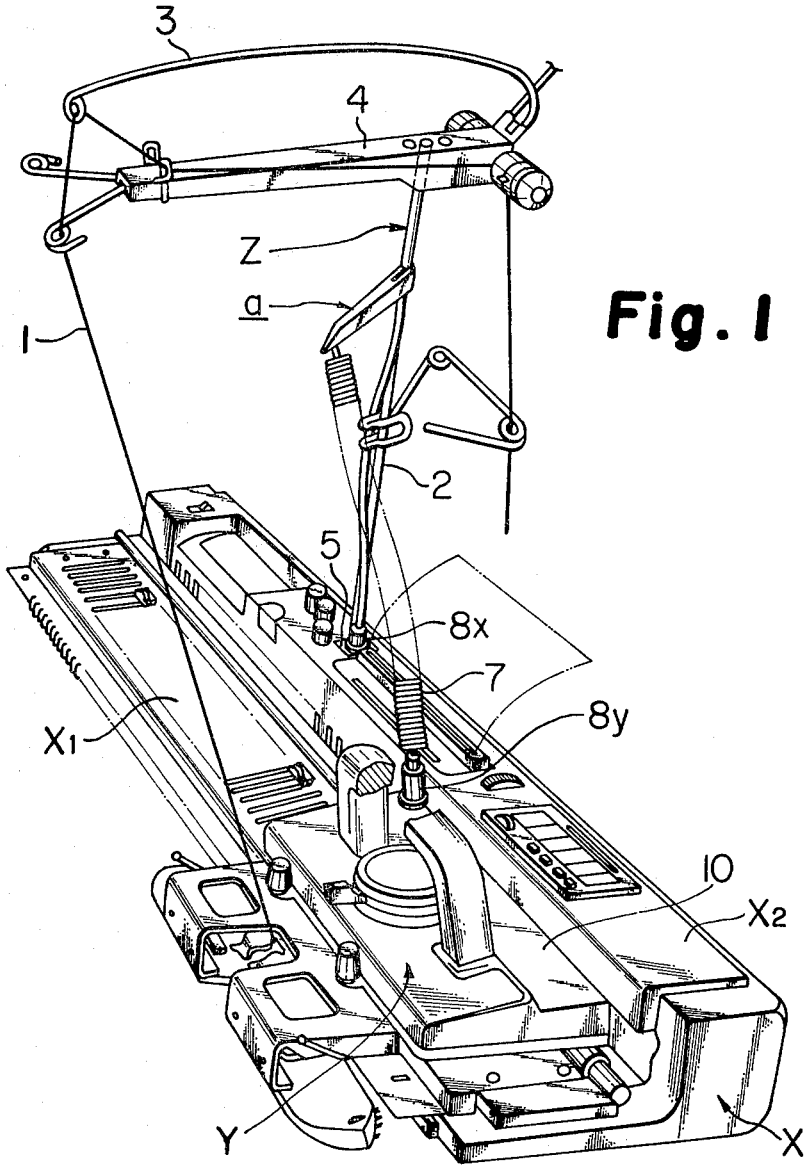
FIG. 1 is a perspective view generally illustrating a hand-operated knitting machine.

Referring now to FIG. 1, a knitting machine body X has a carriage Y mounted and adapted to be moved slideably on a needle bed $X_1$ of the machine body X.

A take-up device Z provides tension to a knitting yarn 1 to be delivered to knitting needles in the needle bed through a yarn feeder on the carriage Y. The take-up device Z includes an assembly 4 removably mounted on the top end of a support rod 2 which extends uprightly and is removably mounted on the machine body X, and a pair of take-up springs 3 carried on said assembly 4.

Figure 2:
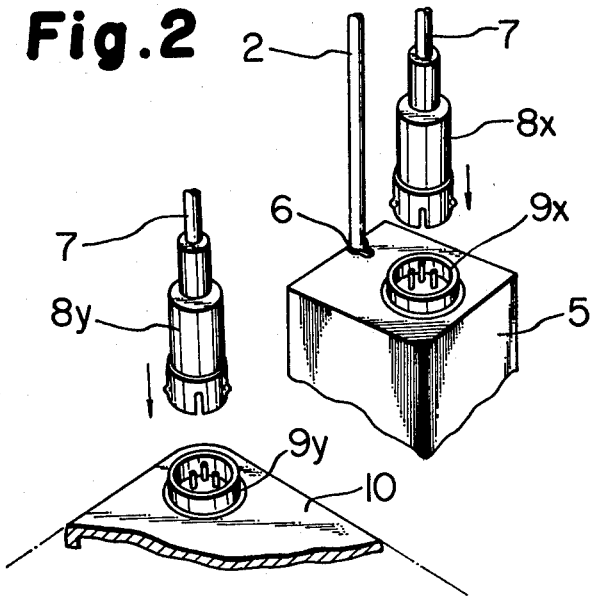
FIG. 2 is a perspective view illustrating mating connection of plugs with jacks.

The support rod 2 is removably mounted on a stand 5 on a control board $X_2$ on the machine body X by inserting the lower end of the rod 2 in a socket 6 provided at the top of the stand 5, as shown in detail in FIG. 2.

A flexible connection cable or cord 7 having therein a plurality of separate electric conductors or wires is provided with plugs 8*x* and 8*y* at its respective ends. The plugs 8*x* and 8*y* are matingly connectable, respectively, to a jack 9*x* fixed to the stand 5 and to a jack 9*y* provided on an upper cover 10 of the carriage Y. When thus connected, cable 7 electrically connects electric circuit means (not shown) such as a power source or a drive or controller circuit means on the machine body X with other electric circuit means (not shown) such as an electromagnet of an electro-mechanical needle selection means on the carriage Y.

Figure 3:
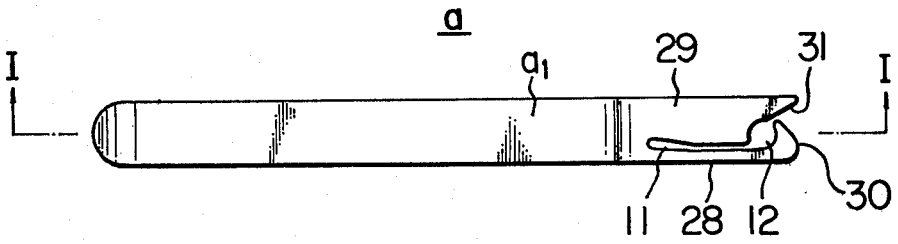
FIG. 3 is a plan view of a lever employed in the device according to the invention.
Figure 4:
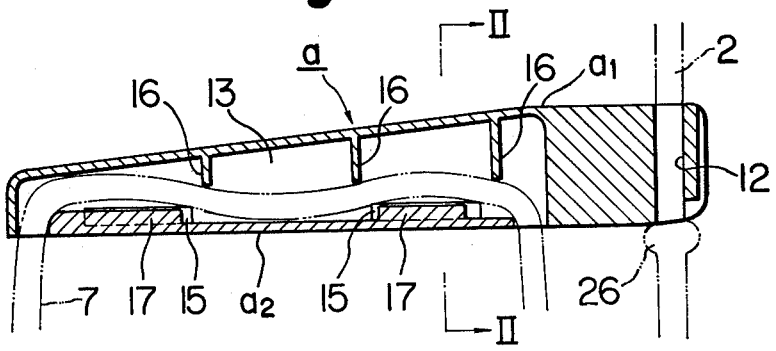
FIG. 4 is a sectional view of the lever taken along line I—I of FIG. 3.
Figure 5:
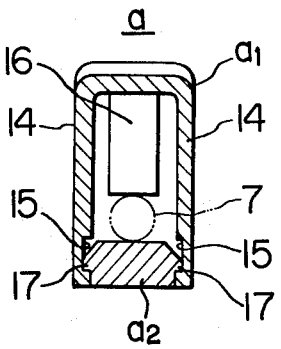
FIG. 5 is a sectional view of the lever taken along line II—II of FIG. 4.

As illustrated in FIGS. 1 and 2, portions of the cord 7 are carried along the support rod 2 which is employed as a suspending means, and are hung down loosely from the suspending rod 2 and from a lever "*a*" mounted on the rod 2. The cord 7 is directly gripped by the lever "*a*", as further illustrated and described in FIGS. 3 through 5.

The lever "*a*" includes a molded upper body member $a_1$ and a molded bottom cover $a_2$, both made of a suitable synthetic resin. The upper member $a_1$ is bifurcated at one end thereof to form two fingers 28 and 29 to cooperatively define therebetween a narrow vertical slit 11. The first finger 28 is made thinner than the second finger 29. The finger 28 has an appropriate thickness and flexibility to make deflectable movement towards and from the finger 29. The finger 28 is also formed to define in cooperation with the finger 29 at a point intermediate of the slit 11 a vertical rounded slot 12 for receiving the support rod 2 and for allowing pivotal motion of the lever "*a*" about the rod 2. The fingers 28 and 29 have at the outer ends camming surfaces 30 and 31, respectively, disposed in a V-configuration.

As a result of the foregoing arrangement, when the V-configuration portion of lever "*a*" is forced against the support rod 2 to mount the lever "*a*" on the rod 2, the rod 2 is permitted to be received in the slot 12 of the lever "*a*" because the thinner finger 28 is flexibly deflected from the finger 29 as a result of the forces developed on the wedge-like camming surfaces 30 and 31. The lever "*a*" is then mounted and supported at a predetermined vertical position on the support rod 2 by a conventional suitable means, such as a pair of radial lugs 26 (FIG. 7) formed on said rod 2 by press work or a snap ring 25 mounted in a circumferential groove 27 or the like.

The upper member $a_1$, includes means 16 partly defining a space or room 13. The cord 7 passes along a major length of the lever "*a*", through the space 13 and next to cover mounting grooves 15 formed in the inside of side walls 14 and adapted to receive a lower cover $a_2$. The lower cover $a_2$ is formed in a plate-like configuration having a length less than that of the concave space 13 and is provided with projections 17 to be inserted in the foregoing cover mounting grooves 15.

By mounting the lower cover $a_2$ on the body member $a_1$ with a portion of the cord 7 inserted in the space 13 defined by the body $a_1$ and the cover $a_2$ (the projections 17 being forced in the cover mounting grooves 15), the cord 7 is fixedly gripped by the lever "a" so that it extends in the room 13 between an opening defined by the front end of the lower cover $a_2$ and the front end of the body member $a_1$, and another opening defined by the rear end of the lower cover $a_2$ and the rear end of the upper member $a_1$. The cord 7 is thereby held and prevented from moving longitudinally by frictional engagement with the lugs 16.

The cord 7 has, intermediately between the lever "a" and plug 8y, a plurality of helical or coiled windings providing sufficient elasticity to take up slackening. As a result, the connecting cable 7 is prevented from entangling with the machine or otherwise causing trouble during machine operation.

In operation of the knitting machine, the cable 7 attempts to make rocking movement in response to the running of the carriage Y and the "a" is pivoted appropriately in accordance with the carriage movement. As a result, the operator can work at the machine without suffering difficulty due to the cable 7 entangling with or catching on parts of the machine.

The jack 9x on the machine body X is preferably provided in the vicinity of the socket 6 on the stand 5 to minimize the likelihood of interference with machine operation from the portion of the cable 7 between the jack 9x and the lever "a".

In an alternative embodiment (FIGS. 6 and 7), a modified lever "a" is attached to the support rod 2 by means of a lever control device 18 which is adapted to prevent an excessive pivotal movement of the lever "a". The lever control device 18 is formed by molding a synthetic resin or similar material as in the first embodiment. A hole 19 is provided in the center of the lever control device 18, and two pairs of axial grooves 20 and 21 for receiving radial lugs 26 are provided in equally spaced circumferential positions around the hole 19. The first pair of grooves 20 pass through the full length of the control device 18 along the axis of the hole 19, while the second pair of grooves 21 have one end closed as shown in FIG. 7.

The lever control device 18 is attached to the support rod 2 in an appropriate position so that the radial lugs 26 of the rod 2 are received in the blind grooves 21 so that control device 18 is prevented from being pivoted on and relative to the axis of the support rod 2. The lever control device 18 is also prevented from being axially moved on and relative to the support rod 2 by means of the lugs 26 and a snap ring 25 mounted in the circumferential groove 27 formed on the rod 2.

The lever control device 18 is further provided with a pair of sectoral depressions, each being defined by a contact surface 22 and a pair of abutment or stop surfaces 23 perpendicular to said contact surface 22.

Figure 6:
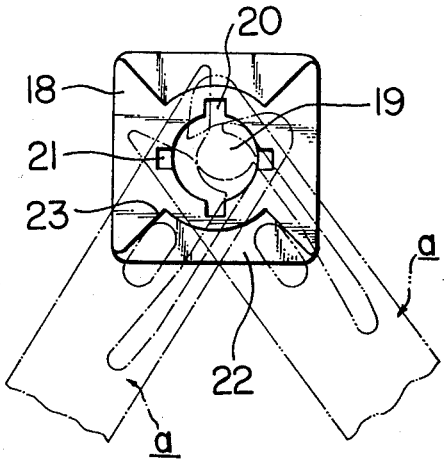
FIG. 6 is an enlarged top plan view generally illustrating a lever control device according to a second embodiment of the invention.
Figure 7:
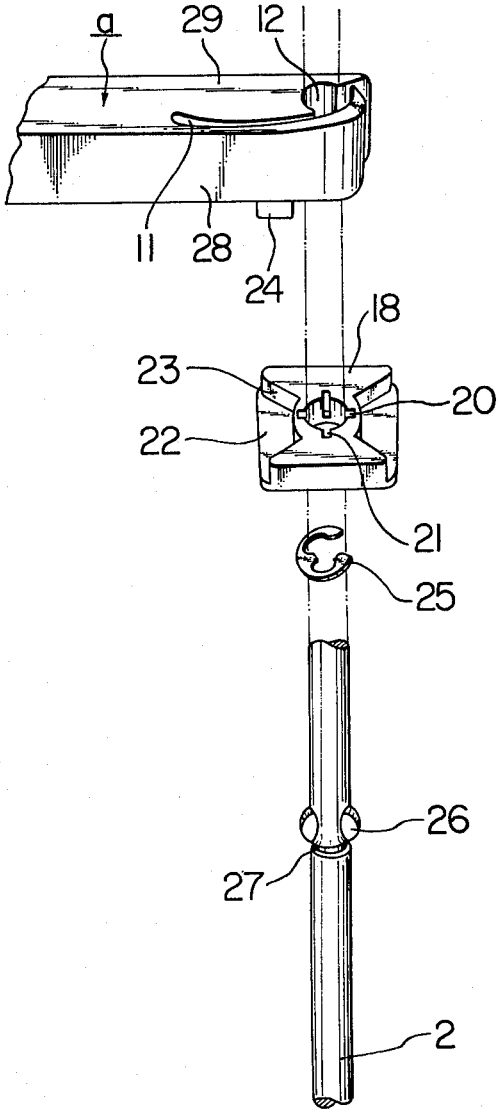
FIG. 7 is an exploded view illustrating the interrelationship between a rod and lever.

The modified lever "a" shown in FIG. 7 is additionally provided with a projection or counterstop 24 which extends downwardly from the bottom of the lever "a" and rests, when mounted in position, on the contact surface 22 of the lever control device 18 for slideable contact with the contact surface 22 and also for abutment against the abutment surfaces 23. As a result, the pivotal movement of the lever "a" is limitedly blocked at the positions shown in one-point and two-point dotted lines by the contact of the projection 24 with the abutment surfaces 23. The lever "a" in FIGS. 6 and 7 is thereby prevented from excessive pivotal movement beyond a predetermined angular distance during operation of the knitting machine.

What is claimed is:

1. In a hand-operated knitting machine having a machine body, a needle bed on said machine body, a carriage mounted for sliding movement on the needle bed, first circuit means on the machine body, and second circuit means on the carriage, the improved apparatus for establishing electrical connection between said first and second circuit means, comprising:

a first jack means fixed on the machine body and electrically connected to the first circuit means;

a second jack means fixed on the carriage and electrically connected to the second circuit means;

a flexible electrical connecting cable adapted to provide electrical connection between the first and second circuit means, said connecting cable having a first and a second plug means for mating connection with said first and second jack means respectively;

supporting means on the machine body for supporting a portion of said connecting cable above said needle bed and the carriage; and means for taking up slack in said cable between said portion of said cable and said second plug means so that said connecting cable is prevented from interfering with operation of the knitting machine.

2. Apparatus as described in claim 1, wherein said supporting means includes a support rod mounted uprightly on the machine body, and a lever mounted on said support rod in a position above and apart from the machine body for horizontal pivotal motion about said support rod, said cable being suspended from said lever at the free end of said lever.

3. Apparatus as described in claim 2, wherein said lever includes two cover members formed to cooperatively define an elongated room for receiving said cable, said elongated room extending along the major length of said lever.

4. Apparatus as described in claim 3, wherein said pair of cover members are made of synthetic resins.

5. Apparatus as described in claim 3, wherein said lever includes means for fixedly holding said cable in said room thereof, said means including one or more lugs extending from one to the other of said members for frictional engagement with said cable.

6. Apparatus as described in claim 3, wherein one of said members is made of synthetic resins, said member having a pair of fingers cooperatively defining a slit and an integral continued slot for receiving said support rod therein, one of said fingers having thickness sufficient to permit deflection movements towards and away from the other finger to fixedly grip said support rod in cooperation with said other finger.

7. Apparatus as described in claim 1, wherein said supporting means includes a support rod mounted uprightly on the machine body, a lever mounted for pivotal motion about and removable from said support rod, and means for holding said lever in a predetermined vertical position on said support rod, said cable being carried on said lever at the free end portion of said lever.

8. Apparatus as described in claim 7, wherein said holding means includes a lever control device removeably mounted on said support rod and having a pair of stop means for allowing only limited pivotal motion of said lever about said support rod, said lever having thereon a counterstop for engagement with said stop means.

9. Apparatus as described in claim 1, wherein said taking-up means comprises a plurality of coiled windings in said cable.

10. In a hand-operated knitting machine having a machine body, a needle bed on the machine body, a carriage slideably mounted on the needle bed, first circuit means on the machine body, and second circuit means on the carriage, the improved apparatus for establishing an electrical connection between said first and second circuit means, comprising:

a jack means mounted at the top of the carriage and electrically connected to the second circuit means;

a plug means adapted to mate with said jack means;

a flexible electrical cable having one end attached to said plug means and the other end connected to said first circuit means and adapted to provide electrical connection between said first and said second circuit means when said jack and plug are mated; and an upright support member removeably mounted on the machine body for supporting an intermediate portion of said cable above and apart from the carriage, said cable having a plurality of coiled windings for taking up slack in said cable between said plug means and said portion thereof.

11. Apparatus as described in claim 10, wherein said support member includes means for holding the intermediate portion of said cable to allow movement of said cable in a horizontal plane in response to the movement of the carriage along the needle bed.

12. A hand-operated knitting machine, comprising:

a machine body;

a needle bed on said machine body;

knitting needles in said needle bed;

a carriage slideably mounted on said needle bed and carrying thereon a yarn feeder for feeding a yarn to said knitting needles;

a take-up device for said yarn including a take-up spring and a support rod therefor, said support rod being mounted uprightly and dismountably on the machine body;

an electrically operated means on said carriage;

circuit means on said machine body for operating said electrically operated means when electrically connected thereto;

flexible cable means for establishing electrical connection between said circuit means and said electrically operated means; and means mounted on said support rod for holding said cable means at an appropriate position so that said cable means is prevented from interfering with operation of the knitting machine.

* * * * *